US009957660B2

(12) United States Patent
Kim et al.

(10) Patent No.: US 9,957,660 B2
(45) Date of Patent: May 1, 2018

(54) WASHING MACHINE

(71) Applicant: SAMSUNG ELECTRONICS CO., LTD., Suwon-si, Gyeonggi-do (KR)

(72) Inventors: Sang Wook Kim, Suwon-si (KR); Hong Seok Ko, Yongin-si (KR); Yongjie Jin, Seoul (KR); Jae Sin Kim, Suwon-si (KR); Kyung Up Lim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 160 days.

(21) Appl. No.: 14/532,115

(22) Filed: Nov. 4, 2014

(65) Prior Publication Data

US 2015/0128657 A1 May 14, 2015

(30) Foreign Application Priority Data

Nov. 8, 2013 (KR) ..... 10-2013-0135775

(51) Int. Cl.
*D06F 39/08* (2006.01)
*D06F 23/04* (2006.01)
*D06F 37/24* (2006.01)

(52) U.S. Cl.
CPC ..... *D06F 39/083* (2013.01); *D06F 39/08* (2013.01); *D06F 39/088* (2013.01); *D06F 23/04* (2013.01); *D06F 37/24* (2013.01)

(58) Field of Classification Search
CPC ..... D06F 23/04; D06F 39/08; D06F 39/088; D06F 39/083
See application file for complete search history.

(56) References Cited

U.S. PATENT DOCUMENTS 2,723,550 A * 11/1955 Belaieff ..... D06F 39/08 392/458
3,170,314 A * 2/1965 Worst ..... D06F 13/00 68/12.13
5,768,730 A * 6/1998 Matsumoto ..... D06F 25/00 210/144
5,953,939 A * 9/1999 Guerrero-Parra ..... D06F 23/04 68/23.2
7,677,062 B2 * 3/2010 Zaccone ..... D06F 25/00 68/207
2003/0051514 A1 * 3/2003 Kim ..... D06F 23/06 68/18 F
2009/0249838 A1 * 10/2009 Kim ..... D06F 39/083 68/58

(Continued)

OTHER PUBLICATIONS

Chinese Decision on Grant dated Feb. 3, 2015 in corresponding Chinese Patent Application No. 201420680121.0.

*Primary Examiner* — Joseph L Perrin
(74) *Attorney, Agent, or Firm* — Staas & Halsey LLP

(57) ABSTRACT

A washing machine including: a cabinet; a tub mounted inside the cabinet to receive washing water; a rotating drum mounted inside the tub to load laundry therein; and an injection unit to inject washing water inside of the rotating drum. The injection unit includes: a plurality of nozzles spaced away from each other to inject washing water inside of the rotating drum at different positions; and a connector configured to include a plurality of passages so that a flow path of washing water diverges into the plurality of nozzles. Washing water may be injected by the spaced nozzles over a wide area inside the drum.

6 Claims, 9 Drawing Sheets

(56) References Cited

U.S. PATENT DOCUMENTS

| | | | | |
|---|---|---|---|---|
| 2009/0249840 | A1* | 10/2009 | Jo | D06F 39/008 68/5 C |
| 2010/0000266 | A1* | 1/2010 | Chung | D06F 39/083 68/205 R |
| 2010/0236001 | A1* | 9/2010 | Lee | D06F 33/02 8/159 |
| 2010/0294004 | A1* | 11/2010 | Hu | D06F 29/00 68/13 R |
| 2011/0088172 | A1* | 4/2011 | Im | D06F 33/02 8/137 |
| 2012/0090360 | A1* | 4/2012 | Nolan | D06F 23/04 68/12.19 |
| 2013/0145562 | A1* | 6/2013 | Lee | D06F 37/266 8/137 |

* cited by examiner

WASHING MACHINE

CROSS-REFERENCE TO RELATED APPLICATIONS

This application claims the benefit of Korean Patent Application No. 10-2013-0135775, filed on Nov. 8, 2013 in the Korean Intellectual Property Office, the disclosure of which is incorporated herein by reference.

BACKGROUND

1. Field

Embodiments of the present disclosure relate to a washing machine, and more particularly, to a washing machine with an improved structure of an injection unit of injecting washing water.

2. Description of the Related Art

A washing machine is configured to wash laundry by use of electricity. The washing machine includes a tub to receive water, a rotating drum rotatably mounted inside the tub, a pulsator rotatably mounted at the bottom of the rotating drum, a motor to rotate the rotating drum and the pulsator, and a clutch to transfer rotatory power to the rotating drum selectively according to a washing process or a drying process.

As the rotating drum and the pulsator rotate in a state that washing water and detergent are introduced in the rotating drum, the pulsator stirs the washing water together with laundry put into the rotating drum to remove dirt from laundry.

In general, washing water is injected through an injection unit disposed in the rotating drum. In order to inject washing water at different positions, a nozzle configured to inject washing water is used. However, since the nozzle cannot inject washing water over a wide area.

SUMMARY

Therefore, it is an aspect of the present disclosure to provide a washing machine with an improved injection unit so that washing water can be injected over a wide area.

Additional aspects of the disclosure will be set forth in part in the description which follows and, in part, will be obvious from the description, or may be learned by practice of the disclosure.

In accordance with one aspect of the present disclosure, a washing machine includes: a cabinet; a tub mounted inside the cabinet, and configured to receive washing water; a rotating drum mounted inside the tub, and configured to load laundry therein; and an injection unit configured to inject washing water to the inside of the rotating drum, wherein the injection unit includes: a plurality of nozzles spaced away from each other to inject washing water to the inside of the rotating drum at different positions; and a connector configured to include a plurality of passages so that a flow path of washing water diverges into the plurality of nozzles.

The injection unit may further include a connection hose connecting one nozzle of the plurality of nozzles to the connector.

The injection unit may further include a pump configured to pump washing water and to make the washing water flow to the plurality of nozzles.

An integrated hose through which washing water flows may be disposed between the pump and the connector.

The injection unit may include a first nozzle, and a second nozzle connected to the connector through the connection hose.

The connector may include an inlet connected to the integrated hose and configured to receive washing water, a first outlet configured to communicate with the first nozzle, and a second outlet configured to communicate with the second nozzle.

The second outlet may be in alignment with the inlet, and the first outlet may diverge at a diverging area which is an area between the second outlet and the inlet.

A diameter of the diverging area that communicates with the first outlet may be greater than a diameter of a diverging area that communicates with the second outlet.

The washing machine may further include a fixing unit including a rest structure that is coupled with the upper part of the tub, the rest structure configured to rest at least one part of the injection unit.

The fixing unit may include at least one through hole through which the plurality of nozzles of the injection unit communicate with the inside of the rotating drum.

In accordance with another aspect of the present disclosure, a washing machine includes: a cabinet; a tub mounted inside the cabinet, and configured to receive washing water; a rotating drum mounted inside the tub, and configured to load laundry therein; and an integrated hose through which washing water flows so that washing water is injected to the inside of the rotating drum; a first nozzle and a second nozzle diverging from the integrated hose, and configured to inject washing water at different positions of the rotating drum; and a connection hose connecting the first nozzle to the second nozzle.

The washing machine may further include a connector having one end coupled with the integrated hose, and the other ends respectively coupled with the first nozzle and the second nozzle.

The connector may include an inlet configured to receive washing water from the integrated hose, a first outlet configured to communicate with the first nozzle, and a second outlet configured to communicate with the second nozzle.

The connector may include diverging areas at which the inlet diverges into the first outlet and the second outlet, and a diameter of a diverging area that communicates with the first outlet may be greater than a diameter of a diverging area that communicates with the second outlet.

The second outlet may be in alignment with the inlet.

The washing machine may further include a fixing unit including a rest structure coupled with the upper part of the tub and configured to rest the connection hose thereon, and at least one through hole into which the first nozzle and the second nozzle are respectively inserted.

The connection hose may be rested along a circumference of the fixing unit. In accordance with another aspect of the present disclosure, in a washing machine including a cabinet, a tub mounted inside the cabinet, a rotating drum mounted inside the tub, and a plurality of nozzles configured to inject washing water to the inside of the rotating drum, the washing machine includes: a pump configured to pump washing water to the plurality of nozzles; an integrated hose disposed between the pump and the plurality of nozzles; and a connector disposed between the integrated hose and the plurality of nozzles, and configured to diverge into a plurality of passages so that washing water move through the respective nozzles.

The connector may include an inlet coupled with the integrated hose, and configured to receive washing water from the integrated hose, and a plurality of outlets configured to communicate with the plurality of nozzles, respectively.

The plurality of outlets may diverge at a predetermined angle with respect to each other.

The plurality of outlets may have different diameters.

At least one of the plurality of outlets may be in alignment with the inlet.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
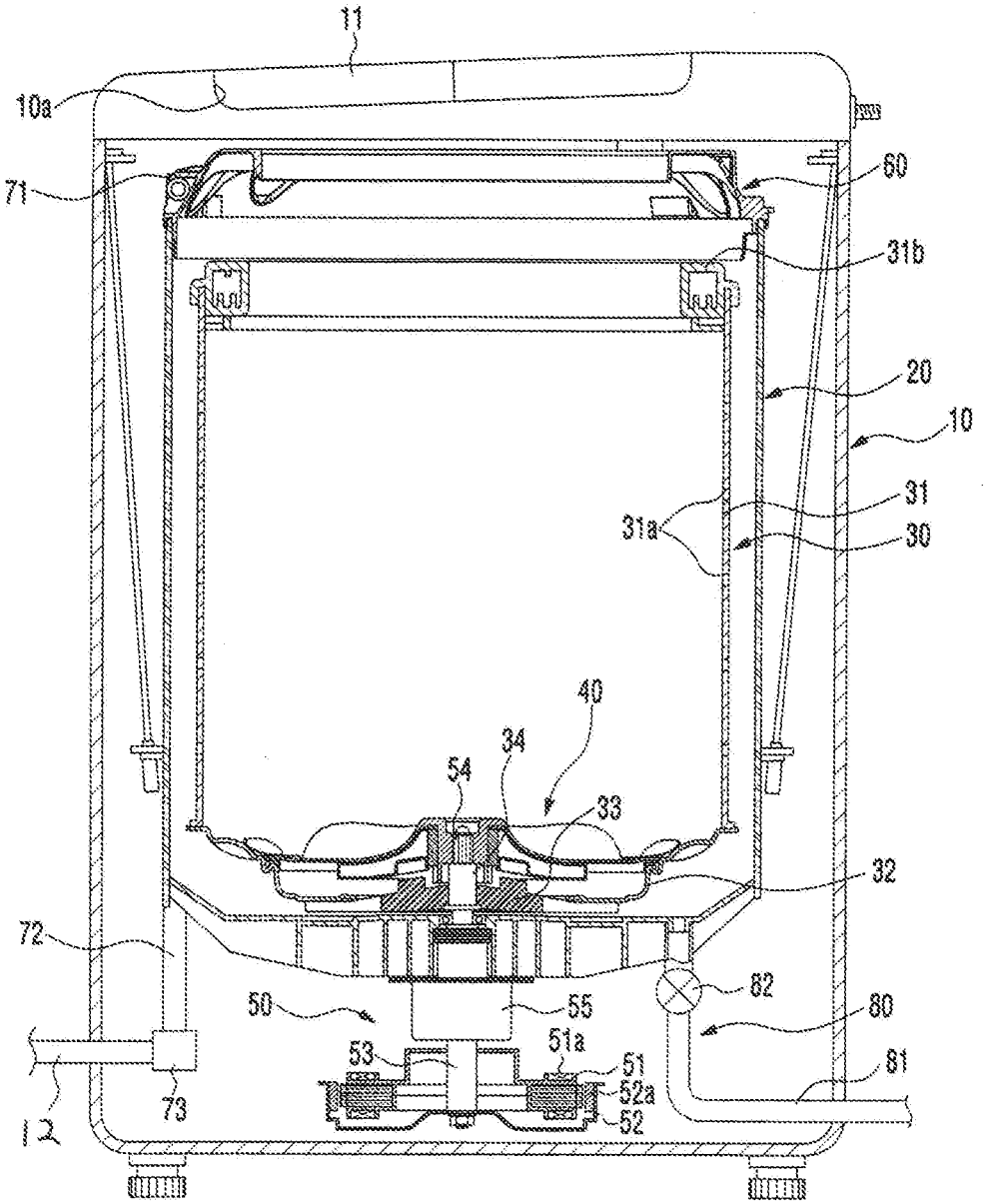
FIG. 1 is a cross-sectional view of a washing machine according to an embodiment of the present disclosure.

Reference will now be made in detail to the embodiments of the present disclosure, examples of which are illustrated in the accompanying drawings, wherein like reference numerals refer to like elements throughout.

FIG. 1 is a cross-sectional view of a washing machine according to an embodiment of the present disclosure.

Referring to FIG. 1, a washing machine according town embodiment of the present disclosure may include a cabinet 10 constituting an external appearance of the washing machine, a tub 20 mounted inside the cabinet 10 and configured to receive water therein, a rotating drum 30 rotatably mounted inside the tub 20, a pulsator 40 mounted in the rotating drum 30 and configured to generate streams of water, and a driving unit 50 to rotate the pulsator 40.

In the upper part of the cabinet 10, an opening 10*a* through which a user can put laundry into the rotating drum 30 may be formed. Also, in the upper part of the cabinet 10, a door 11 mounted rotatably with respect to the cabinet 10 may be provided to open or close the opening 10*a*.

The tub 20 may be suspended inside the cabinet 10, and receive water that is to be used for washing. In the upper part of the tub 20, an injection unit 70 (see FIG. 2) to supply water to the tub 20 may be disposed, and below the tub 20, a drain unit 80 to discharge water used for washing to the outside may be disposed. The injection unit 70 may be coupled with a fixing unit 60 that is coupled with the upper part of the tub 20.

The injection unit 70 may include a water supply pipe (not shown) connected to an external water supply source (not shown), and a pump 73 connected to a water supply pipe 12 and configured to pump water to the inside of the rotating drum 30. Washing water may be transferred from the pump 73 to a plurality of nozzles (see reference numerals 77 and 78 of FIG. 3) through an integrated hose 72, and then injected from the plurality of nozzles 77 and 78.

The drain unit 80 may include a drain pipe 81 connected to the lower part of the tub 20, to guide water stored in the tub 20 to be discharged to the outside, and a drain valve 82 coupled with the drain pipe 81 and configured to open or close the drain pipe 81.

The rotating drum 30 may include a body portion 31 having a cylindrical shape wherein the top part opens, and a bottom portion 32 fixed on the lower part of the body portion 31 and constituting the bottom of the rotating drum 30. A plurality of through-holes 31*a* to allow water in the tub 20 to flow into the rotating drum 30 or to discharge water from the rotating drum 30 to the tub 20 may be formed around the body portion 31. Also, a balancer 31*b* may be provided in the upper part of the rotating drum 30 to cancel an unbalanced load of laundry in the rotating drum 30 so that the rotating drum 30 can stably rotate.

The rotating drum 30 may rotate by receiving power from the pulsator 40 through the driving unit 50. For this, the rotating drum 30 may include a driving flange 33 mounted on the bottom portion 32 of the rotating drum 30 and configured to receive power from the pulsator 40.

In the driving flange 33, a hollow dehydrating shaft 34 forming the center of rotation of the rotating drum 30 may be disposed, and a washing shaft 54 may be rotatably inserted in the dehydrating shaft 34.

The pulsator 40 may rotate forwardly or backwardly in the rotating drum 30 to generate streams of water, and laundry in the rotating drum 30 may be stirred by streams of water generated by the pulsator 40 and washed by a friction force.

The driving unit 50 may be disposed below the tub 20, and receive power to generate rotatory power. The driving unit 50 may include a stator 51 having a coil 51*a*, a rotor 52 including a magnet 52*a* to interact with the coil 51*a* and rotate while interacting with the stator 51, a driving shaft 53 wherein a lower end is connected to the center of the rotor 52, a washing shaft 54 to transfer rotatory power to the pulsator 40, and a reduction unit 55 disposed between the driving shaft 53 and the washing shaft 54 and including a planet gear for reduction therein.

Figure 2:
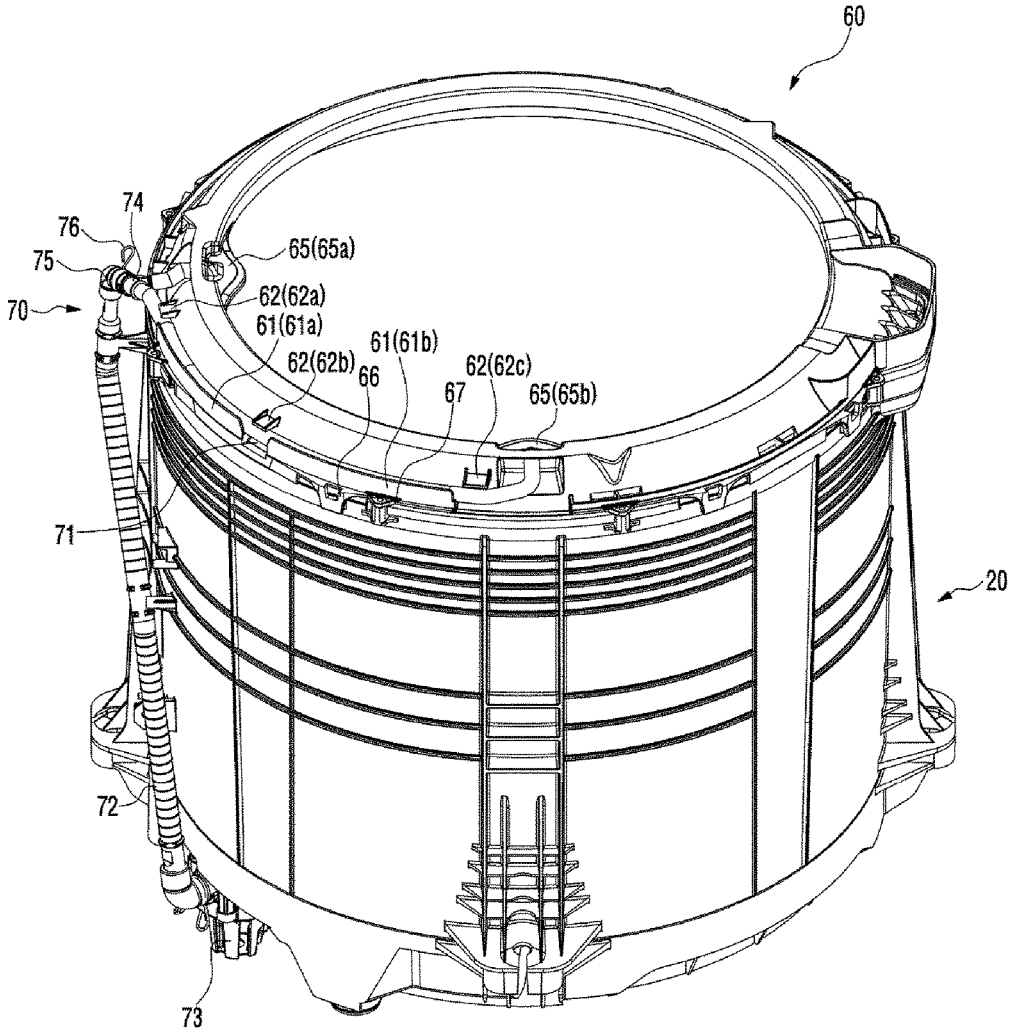
FIG. 2 shows a coupled state of a tub, a fixing unit, and an injection unit of a washing machine according to an embodiment of the present disclosure.
Figure 3:
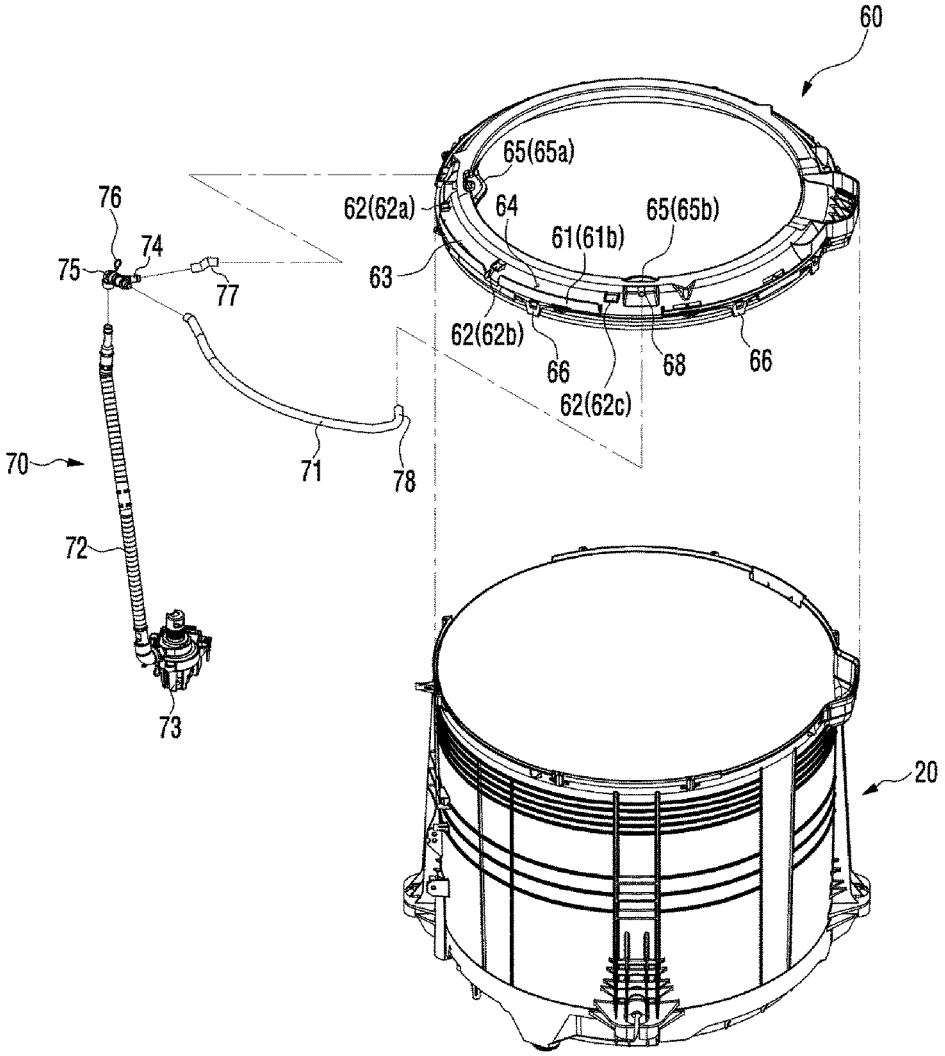
FIG. 3 shows an exploded state of a tub, a fixing unit, and an injection unit of a washing machine according to an embodiment of the present disclosure.

FIG. 2 shows a coupled state of the tub 20, the fixing unit 60, and the injection unit 70 of the washing machine according to an embodiment of the present disclosure, and FIG. 3 shows an exploded state of the tub 20, the fixing unit 60, and the injection unit 70 of the washing machine according to an embodiment of the present disclosure.

Referring to FIGS. 2 and 3, the injection unit 70 may be configured to inject washing water to the inside of the rotating drum 30 (see FIG. 1), and the injection unit 70 may be coupled with the fixing unit 60. The fixing unit 60 may include a rest structure for fixedly securing the injection unit 70. According to an embodiment, the rest structure may be positioned along the circumference of the fixing unit 60.

The injection unit 70 may include the pump 73 to pump washing water, and the integrated hose 72 connecting the pump 73 to the nozzles 77 and 78. The injection unit 70 may include the plurality of nozzles 77 and 78 to inject washing water to the inside of the rotating drum 30 at a plurality of positions. According to an embodiment, the injection unit 70 may include a first nozzle (that is, 77) and a second nozzle (that is, 78) so as to inject washing water to the inside of the rotating drum 30 at two positions. A connector 74 may be disposed between the integrated hose 72 and the plurality of nozzles 77 and 78. The connector 74 may cause a flow path of washing water to diverge into the plurality of nozzles 77 and 78 from the integrated hose 72. The first nozzle 77 may be disposed close to the connector 74, and the second nozzle 78 may be disposed at a location more distant from the connector 74 than the first nozzle 77. A connection hose 71 may connect the second nozzle 78 to the connector 74.

The rest structure may rest the upper, lower, or lateral portion of at least one part of the injection unit 70. The rest unit may include a rest groove 64 (FIG. 4) formed in the outer surface of the fixing unit 60, so that at least one part of the injection unit 70 can be supported by the rest groove 64. The connection hose 71 connecting the second nozzle 78 to the connector 74 may rest on the rest groove 64.

The rest structure may include one or more ribs or projections 61, 62, and 63 to prevent movement of the injection unit 70.

The fixing unit 60 may include an injection part 65 to communicate with the rotating drum 30 so that washing water from the nozzles 77 and 78 can be injected to the inside of the rotating drum 30. The injection part 65 may protrude from the fixing unit 60 toward the inside of the rotating drum 30. According to an embodiment, since two nozzles of the first nozzle 77 and the second nozzle 78 are provided, two injection parts 65*a* and 65*b* may be provided.

The fixing unit 60 and the tub 20 may be coupled by coupling parts. According to an embodiment, the coupling parts may be formed on the fixing unit 60. The coupling parts may include a first coupling part 66 protruding down from the fixing unit 60, and a second coupling part 67 into which a separate clamping element can be inserted. The first coupling part 66 may be coupled with the tub 20 by hook coupling, and the clamping element may be inserted into the second coupling part 67, thereby coupling the tub 20 with the fixing unit 60.

Figure 4:
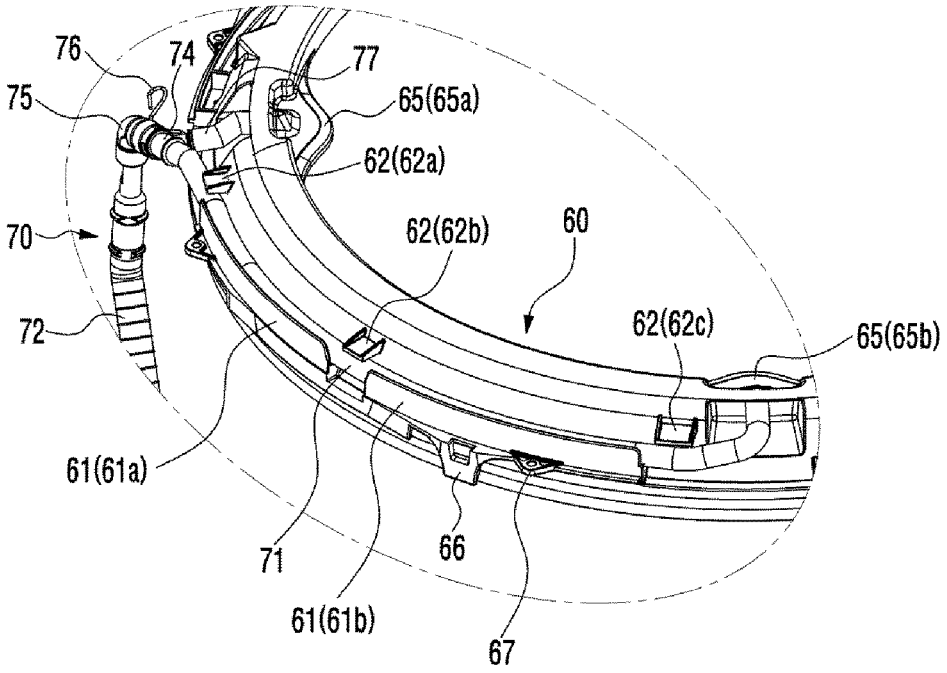
FIG. 4 is an enlarged view showing a coupled state of a fixing unit and an injection unit of a washing machine according to an embodiment of the present disclosure.

FIG. 4 is an enlarged view showing a coupled state of the fixing unit 60 and the injection unit 70 of the washing machine according to an embodiment of the present disclosure.

As shown in FIG. 4, the fixing unit 60 may include the rest structure to rest the injection unit 70. Hereinafter, the rest structure will be described in detail.

The fixing unit 60 may include the rest groove 64 on which the connection hose 71 is rested. According to an embodiment, one or more of the side ribs 61 may be formed around the rest groove 64. The side ribs 61 may extend upward, and prevent the connection hose 71 of the injection unit 70 from moving out of the fixing unit 60.

The rest structure may further include one or more of the upper ribs 62 to secure the upper part of the connection hose 71 of the injection unit 70 in order to prevent up-down movement of the injection unit 70. The upper ribs 62 may be arranged over the connection hose 71, and protrude to partially cover the rest groove 64.

Also, the rest structure may further include lower ribs 63 to support the lower part of the connection hose 71 of the injection unit 70 in order to support the lower part of the injection unit 70.

According to an embodiment, the side ribs 61 and the upper ribs 62 may be arranged alternately. That is, if a region in which each side rib 61 is positioned is defined as a first region, and a region in which each upper rib 62 is positioned is defined as a second region, the first region and the second region may be different regions. That is, the upper ribs 62 may be positioned in regions in which no side ribs 61 are positioned. According to an embodiment, three upper ribs 62*a*, 62*b*, and 62*c*, and two side ribs 61*a* and 61*b* may be provided.

Figure 5:
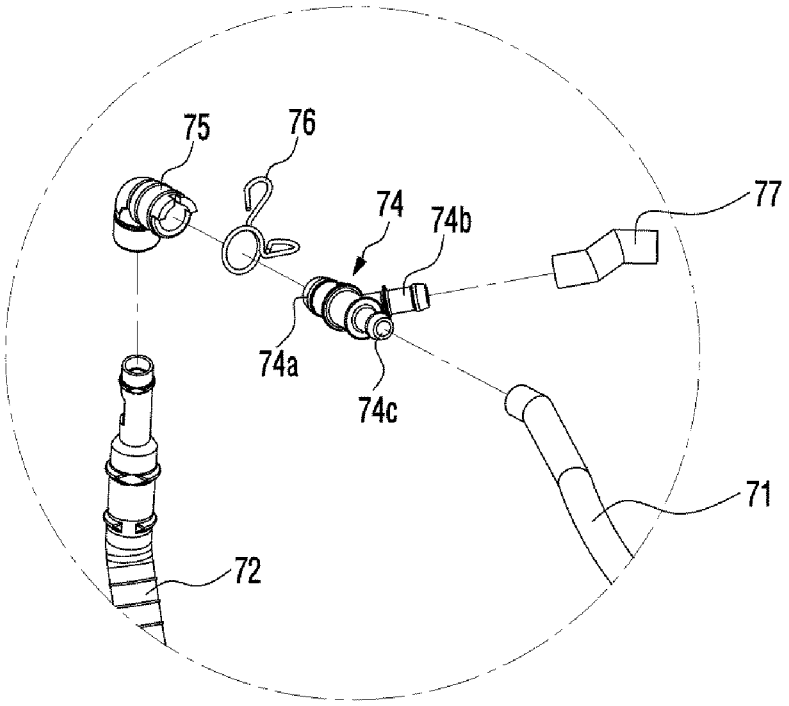
FIG. 5 is an enlarged view showing an exploded state of an injection unit of a washing machine according to an embodiment of the present disclosure.
Figure 6:
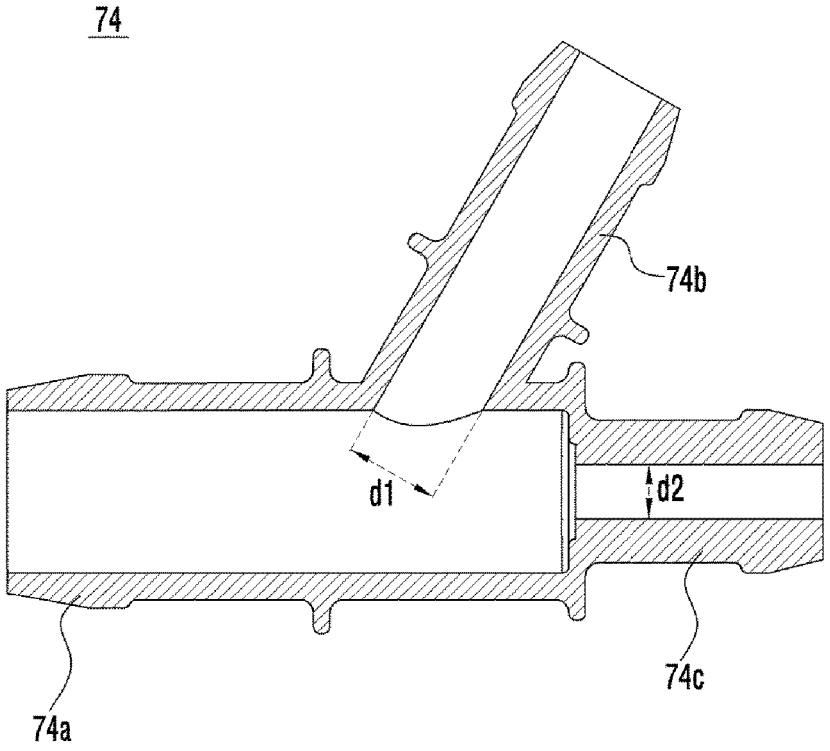
FIG. 6 is a cross-sectional view of a connection of an injection unit of a washing machine according to an embodiment of the present disclosure.

FIG. 5 is an enlarged view showing an exploded state of the injection unit 70 of the washing machine according to an embodiment of the present disclosure, and FIG. 6 is a cross-sectional view of the injection unit 70 of the washing machine according to an embodiment of the present disclosure.

As shown in FIGS. 5 and 6, the injection unit 70 may include the plurality of nozzles 77 and 78, and the connector 74 to cause a flow path of washing water to diverge into the plurality of nozzles 77 and 78.

A guide pipe 75 to guide the flow of washing water may be connected between the connector 74 and the integrated hose 72. The connector 74 may be coupled with the guide pipe 75, and a holder or clamp 76 to fix the guide pipe 75 and the connector 74 may be coupled with the outer surface of the guide pipe 75.

The connector 74 may include an inlet 74*a* to receive washing water from the integrated hose 72, and a plurality of outlets 74*b* and 74*c* connected to the respective nozzles 78 and 77. According to an embodiment, since two nozzles 77 and 78 are provided, two outlets 74*b* and 74*c* may be provided. The first nozzle 77 may communicate with the first outlet 74*b*, and the second nozzle 78 may communicate with the second outlet 74*c*. The connection hose 71 may be connected between the first second nozzle 78 and the second outlet 74*c*.

The second outlet 74*c* that communicates with the second nozzle 78 may be in alignment with the inlet 74*a*. This is aimed at reducing passage resistance of washing water flowing to the second nozzle 78 since the second nozzle 78 is more distant from the connector 74 than the first nozzle 77.

The connector 74 may include diverging areas at which a flow path of water diverges into the first outlet 74*b* and the second outlet 74*c*. The diameter of a diverging area at which the flow path of water diverges into the first outlet 74*b* is defined as d1, and the diameter of a diverging area at which the flow path of water diverges into the second outlet 74*c* is defined as d2. According to an embodiment, d1>d2. This is aimed at minimizing passage resistance of washing water flowing to the first nozzle 77 since the first nozzle 77 diverges at a predetermined angle with respect to the connector 74.

According to the above-described structure of the connector 74, the first nozzle 77 and the second nozzle 78 may be spaced away from each other with a predetermined angle or more. According to an embodiment, the first nozzle 77 and the second nozzle 78 may be disposed at 100 degrees or less with respect to the center axis of the tub 20. However, the angles of the first nozzle 77 and the second nozzle 78 with respect to the center axis of the tub 20 are not limited to this.

Also, the first nozzle 77 and the second nozzle 78 may be controlled to inject the same amount of washing water by adjusting the diverging angles of the first and second outlets 74*b* and 74*c* and the diameters of the diverging areas, although the first nozzle 77 and the second nozzle 78 are spaced away from each other.

Figure 7:
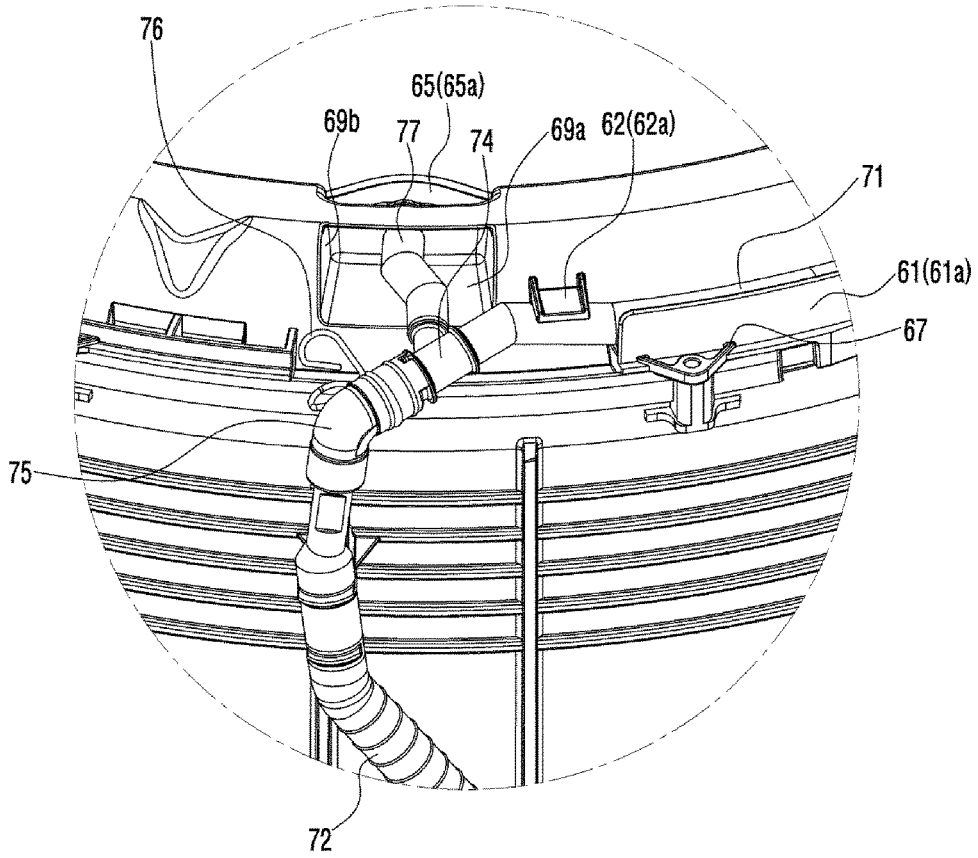
FIG. 7 is an enlarged view showing a nozzle of an injection unit of a washing machine according to an embodiment of the present disclosure.
Figure 8:
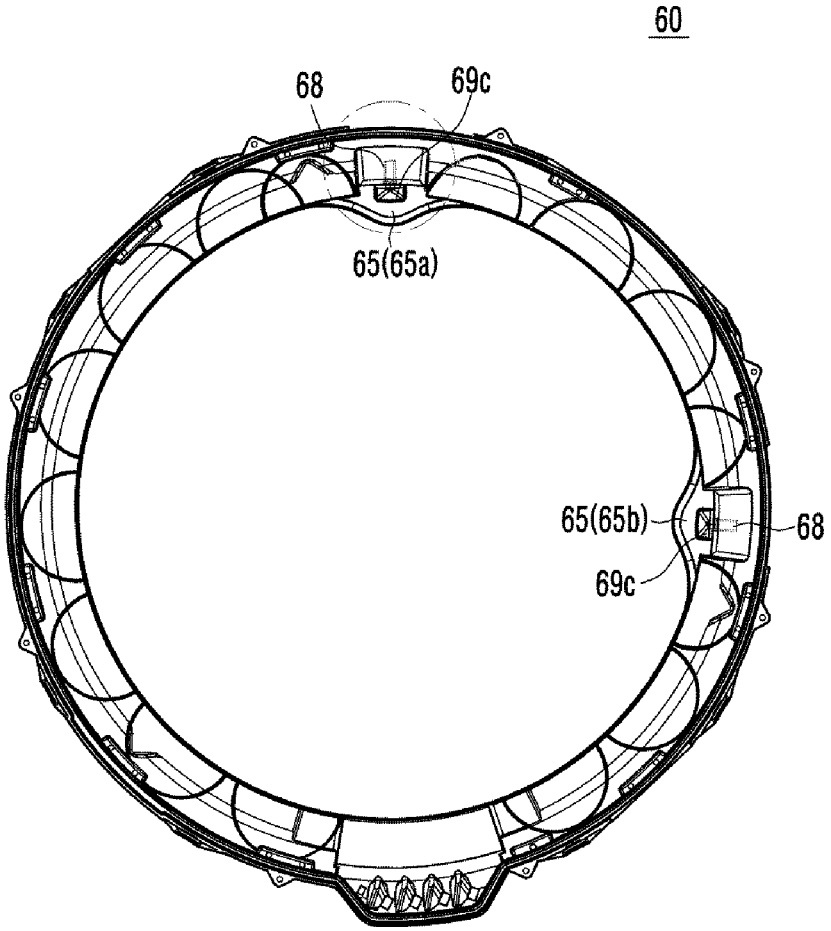
FIG. 8 shows one side of a fixing unit of a washing machine according to an embodiment of the present disclosure.
Figure 9:
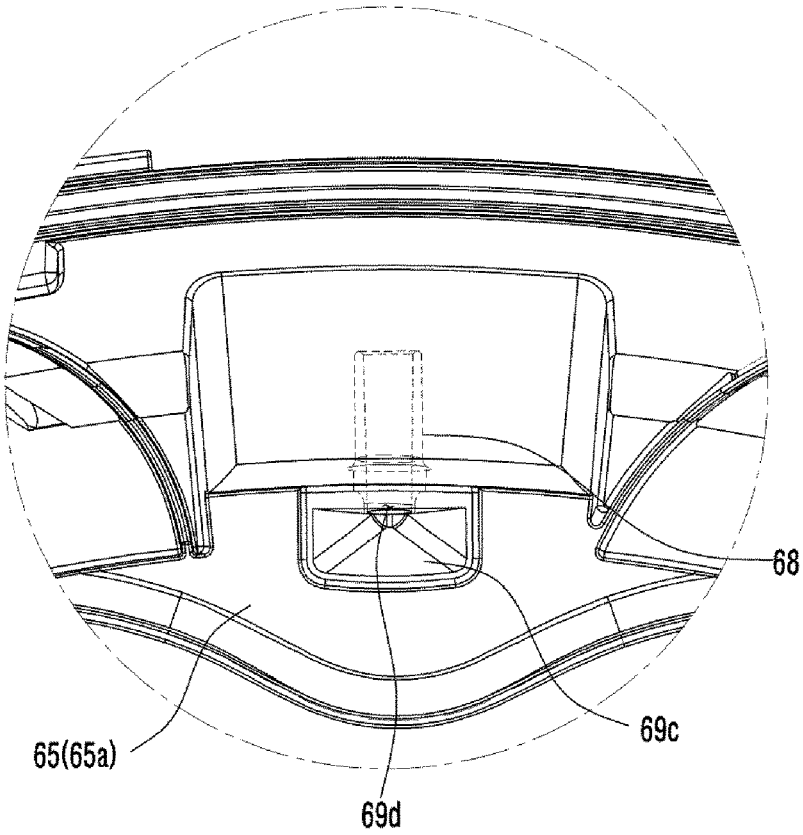
FIG. 9 is an enlarged view showing a portion of FIG. 8.

FIG. 7 is an enlarged view showing the nozzle 77 of the injection unit 70 of the washing machine according to an embodiment of the present disclosure, and FIG. 8 shows one side of a fixing unit of a washing machine according to an embodiment of the present disclosure, in detail, in which a lower side of the fixing unit 60 is viewed. FIG. 9 is an enlarged view showing a portion of FIG. 8.

As shown in FIGS. 7, 8 and 9 the nozzles 77 and 78 may be inserted into the injection parts 65 of the fixing unit 60. The injection parts 65 may protrude toward the inside of the rotating drum 30. The nozzles 77 and 78 may be coupled with through pipes 68 protruding from the injection parts 65.

Ends of nozzles 77 and 78 of the injection unit 70 may be, as described above, inserted into the injection parts 65. The other end of the nozzle 77 is coupled with the outlet 74*b* of the connector 74 and the other end of the nozzle 78 is connected to the hose 71 which is connected to the second outlet 74*c*. The inlet 74*a* of the connector 74 is connected to the guide pipe 75 with the holder 76 fixed to the guide pipe 75.

The bottom 69*a* of each injection part 65 may be protruded upward relative to the rest structure in order to prevent washing water from spurting out. Also, the lateral walls 69*b* of each injection part 65 may be protruded outward relative to the through pipe 68 in order to prevent washing water from spurting out.

A through hole 69*d* is provided on the through pipe 68 such that the through hole 69*d* communicates with the through pipe 68. The through hole 69*d* is provided to face an inner side of the rotating drum 30.

A guide part 69*c* is provided on the injection part 65. The guide part 69*c* is provided to be open toward a lower side of the injection part 65. In other words, the guide part 69*c* is provided to be open toward the rotating tub 30. The guide part 69*c* is formed around the through hole 69*d*. In other words, the through hole 69*d* is formed through an inner surface of the guide part 69*c*. The guide part 69*c* has a width increased as it extends toward the lower side of the injection part 65, that is, toward the rotating tub 30. Accordingly, washing water delivered to the guide part 69*c* through the through hole 69*d* is widely sprayed inside the rotating tub 30. The guide part 69*c* is provided in the form of a pyramid having a width increased as it extends toward the lower side of the injection part 65. However, the shape of the guide part 69*c* is not limited thereto, and may be provided in various shapes as long as the guide part 69*c* has a width increased as it extends toward the lower side of the injection part 65.

The plurality of nozzles 77 and 78 may be connected to the through pipe 68 provided on the injection part 65. In detail, the first nozzle 77 may be connected to the through pipe 68 provided on the first injection part 65*a*, and the second nozzle 78 may be connected to the through pipe 68 provided on the second injection part 65*b*.

According to the embodiments of the present disclosure, since the plurality of nozzles of the injection unit are arranged to be spaced away from each other, washing water may be injected over a wide area inside the drum.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a cabinet;

a tub mounted inside the cabinet to contain washing water, the tub having an upper portion;

a drum mounted inside the tub to receive laundry and to be rotatable, the drum having an open upper portion;

a pump configured to supply washing water;

a plurality of nozzles spaced away from each other on the upper portion of the tub to inject washing water to an inside of the drum via the upper open portion of the drum;

a connector at the upper portion of the tub and having an inlet and two outlets defining a plurality of passages through which washing water flows to the plurality of nozzles;

a first hose extending along a side wall of the tub, a first end of which is connected to the pump and a second end of which is connected to the inlet of the connector to direct washing water from the pump to the connector, wherein the first outlet of the connector communicates with a first one of the plurality of nozzles;

a second hose extending in a circumferential direction of the upper portion of the tub, a first end of which is connected to the second outlet of the connector and a second end of which is connected to a second one of the plurality of nozzles;

a groove that extends along a circumference of the upper portion of the tub to support at least a portion of the second hose;

a lower rib defining a bottom of the groove;

a plurality of side ribs defining a side wall of the groove and corresponding to a surface of the second hose facing an outside of the tub; and a plurality of upper ribs defining an upper wall of the groove and arranged alternately with the plurality of side ribs.

2. The washing machine according to claim 1, wherein:

the second outlet is in alignment with the inlet along a central axis of the connector, and the first outlet is angled relative to the central axis of the connector, and the inlet, the first outlet, the second outlet, the first nozzle and the second nozzle are in continuous washing water communication with each other.

3. The washing machine according to claim 2, wherein a diameter of the first outlet is greater than a diameter of the second outlet.

4. A washing machine comprising:

a cabinet;

a tub mounted inside the cabinet and having an opening on a top side of the tub;

a drum mounted inside the tub to receive laundry and to be rotatable, the drum having an upper opening;

a pump configured to supply washing water;

a fixing unit coupled on the top side of the tub at the opening of the tub;

a first nozzle and a second nozzle disposed at the fixing unit to inject washing water through the opening of the drum and to the inside of the drum;

a connector at the upper position of the tub, and having an inlet, a first outlet, and a second outlet;

a first hose extending along a side wall of the tub, a first end of which is connected to the pump and a second end of which is connected to the inlet of the connector to direct washing water from the pump to the connector, wherein the first outlet of the connector communicates with a first one of the plurality of nozzles;

a second hose extending in a circumferential direction of the upper portion of the tub, a first end of which connects to the second outlet, and a second end of which connects to a second one of the plurality of nozzles; and a groove that extends along a circumference of the top side of the tub to support at least a portion of the second hose, wherein the fixing unit comprises:

a lower rib defining a bottom of the groove;

a plurality of side ribs defining a side wall of the groove and corresponding to a surface of the second hose facing an outside of the tub; and a plurality of upper ribs defining an upper wall of the groove and arranged alternately with the plurality of side ribs.

5. The washing machine according to claim 4, wherein a diameter of the first outlet is greater than a diameter of the second outlet.

6. The washing machine according to claim 5, wherein the second outlet is in alignment with the inlet along an axis of the connector.

* * * * *